United States Patent [19]

Ramer

[11] 4,392,666

[45] Jul. 12, 1983

[54] INTEGRAL SKI BINDING

[75] Inventor: Paul C. Ramer, Golden, Colo.

[73] Assignee: Alpine Research, Inc., Golden, Colo.

[21] Appl. No.: 243,424

[22] Filed: Mar. 13, 1981

[51] Int. Cl.[3] ..... A63C 9/02

[52] U.S. Cl. ..... 280/614; 280/626; 280/633; 280/634; 36/117; 36/38; 36/73

[58] Field of Search ..... 280/611, 613, 614, 615, 280/623, 626, 628, 631, 632, 633, 634, 618, 620; 36/117, 118, 73, 38, 15

[56] References Cited

U.S. PATENT DOCUMENTS

| | | | |
|---|---|---|---|
| 980,173 | 12/1910 | Clark | 36/15 |
| 2,447,603 | 8/1948 | Snyder | 36/38 |
| 3,003,777 | 10/1961 | Hilding | 280/614 |
| 3,490,781 | 1/1970 | Marker | 280/625 |
| 3,606,370 | 9/1971 | Spademan | 280/624 |
| 3,771,806 | 11/1973 | Hintermolzer | 280/613 |
| 3,779,570 | 12/1973 | Betschart | 280/613 |
| 3,797,841 | 3/1974 | McAusland | 280/624 |
| 3,945,134 | 3/1976 | Ramer | 36/118 |
| 3,971,144 | 7/1976 | Brügger-Stuker | 36/117 |
| 4,002,354 | 1/1977 | Ramer | 280/614 |
| 4,157,191 | 6/1979 | Ramer | 280/614 |

*Primary Examiner*—Joseph F. Peters, Jr.
*Assistant Examiner*—Kenneth R. Rice
*Attorney, Agent, or Firm*—Gary M. Polumbus

[57] ABSTRACT

An integral ski boot binding formed by a boot and operably connected boot plate is pivotally and releasably connected at a forward end to a toepiece mounted on a ski. A heel of the boot can be left free for touring skiing or clamped by a heelpiece mounted on the ski for alpine skiing. When the binding is released from the ski, a walking sole is attached to the boot plate. In an alternative embodiment, the boot plate is selectively positionable between two positions. In a first position, for touring, the forward end of the boot plate connects to the toepiece and in a second position, for alpine skiing, the forward end of the boot plate is directed toward a rearward portion of the boot, and connects to the toepiece at a point approximately midway along the length of the boot.

9 Claims, 12 Drawing Figures

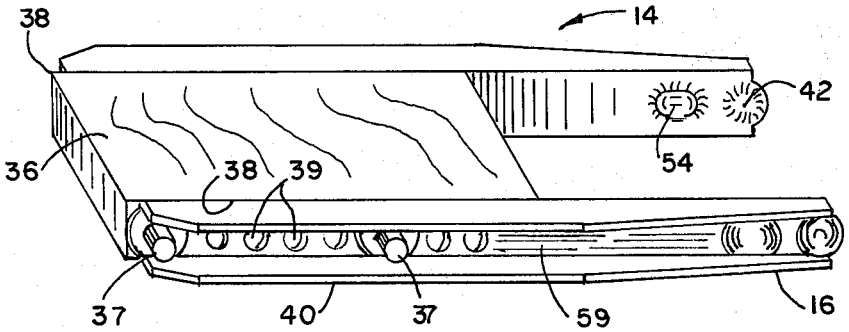
Fig. 2
Fig. 3
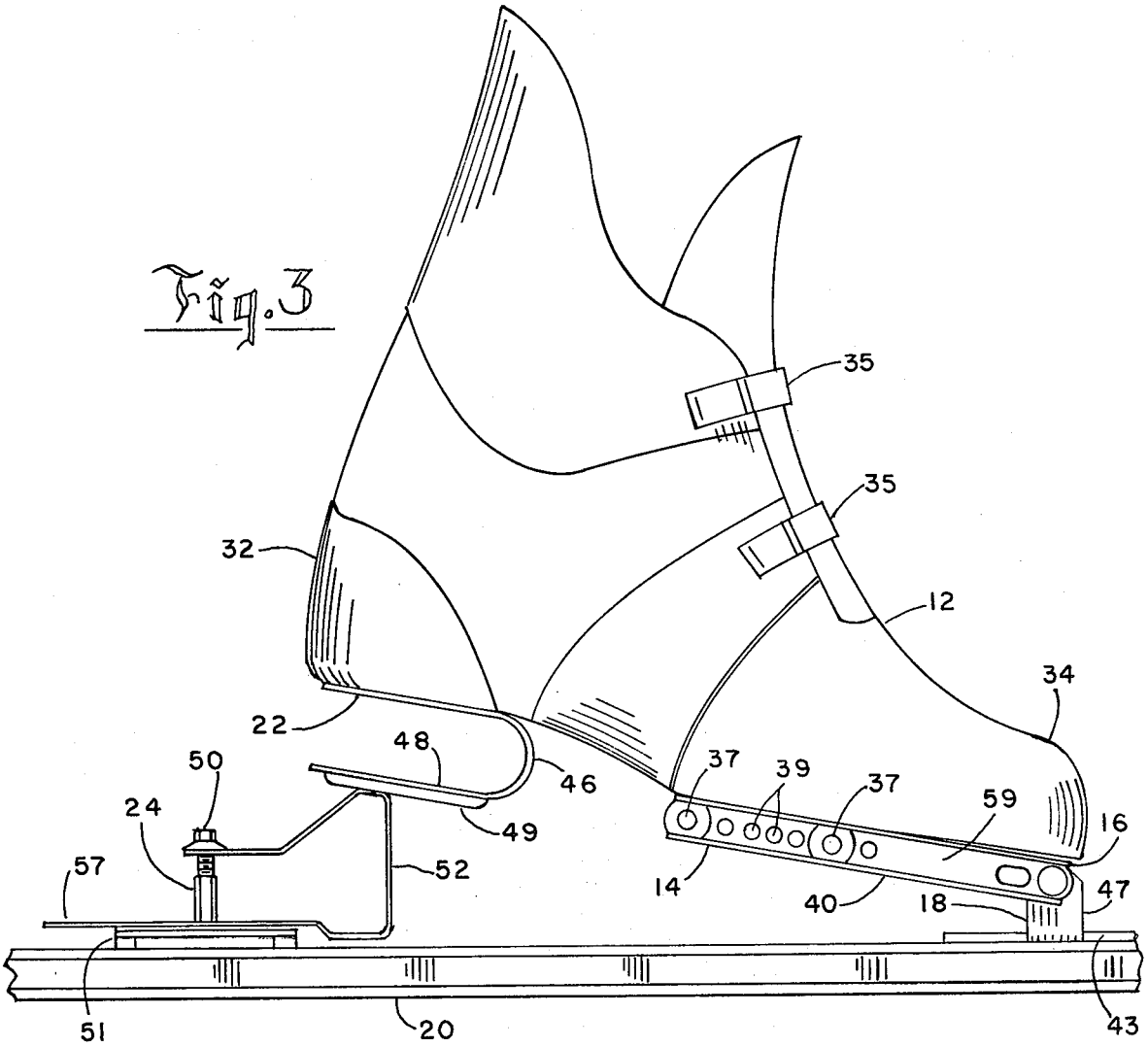

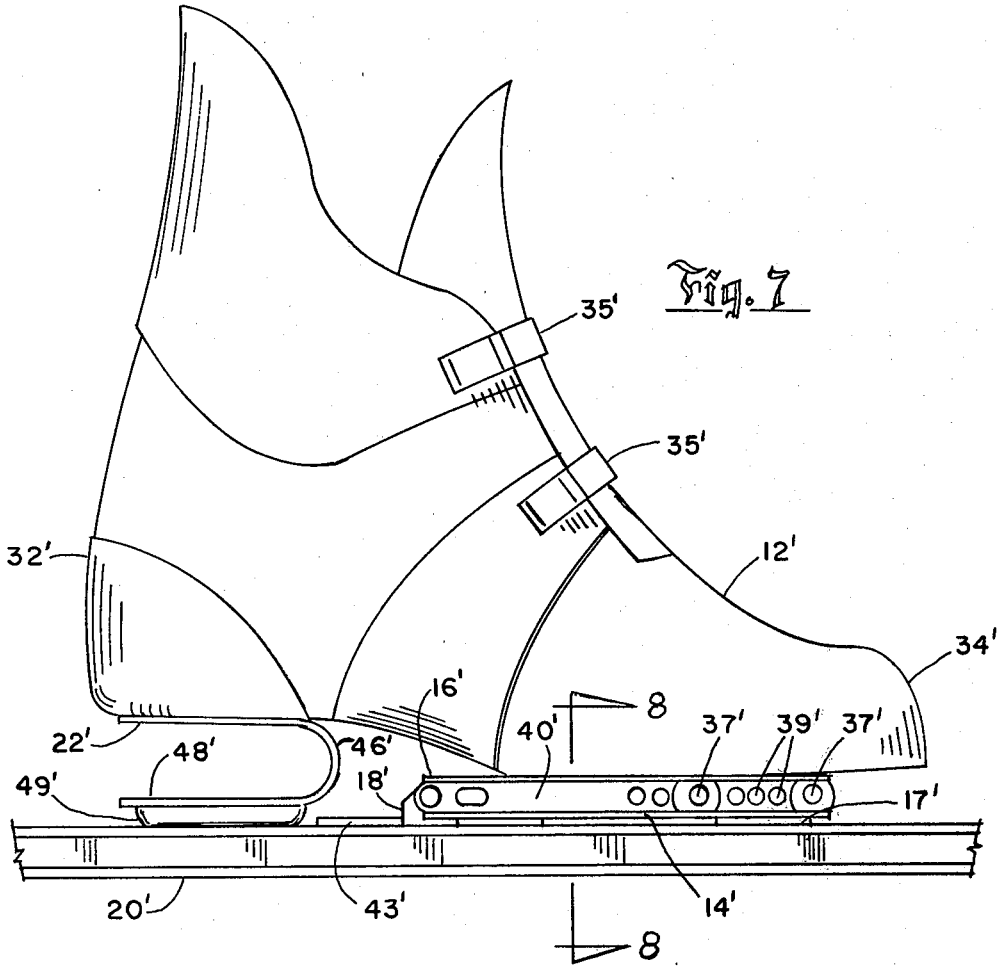
Fig. 7
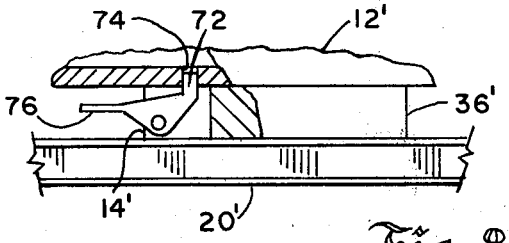
Fig. 8
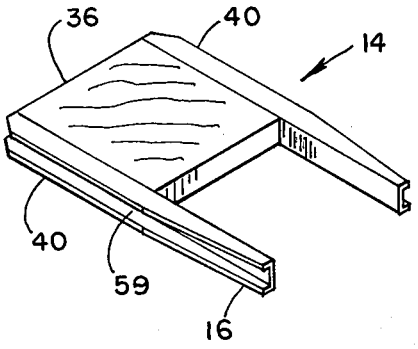
Fig. 9
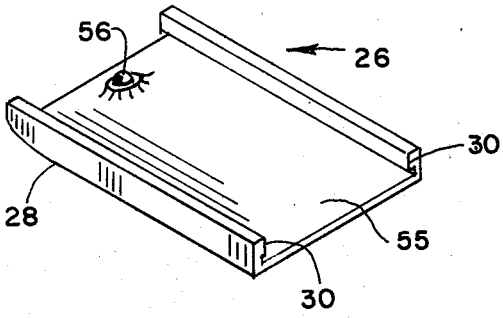

INTEGRAL SKI BINDING

BACKGROUND OF THE INVENTION

1. Field of Invention

The present invention relates generally to ski equipment and more particularly to a snow ski binding adapted for use in both alpine and touring, or cross-country, skiing.

2. Description of the Prior Art

Skiing interest has continued to evolve from pure alpine, or downhill, skiing and pure touring, or cross-country skiing to a combination of both. Where both alpine and touring skiing are capable of being performed by use of the same equipment, the skier's overall skiing experience is enhanced, as well as the skier's ability to traverse varying types of terrain. There have been many drawbacks to equipment attempting to be adaptable to both alpine and touring skiing. These drawbacks can be generalized to one, the previously available equipment results in compromises on either one or the other, or both types of skiing.

My prior U.S. Pat. No. 4,002,354 discloses a ski binding for use in both alpine and touring skiing. That patent utilizes a toepiece rigidly connected to the ski at one end, a heelpiece operably connected to the ski at the other end and an intermediate boot plate to which a ski boot is secured. The boot plate is then releasably secured between the toepiece and heelpiece.

My pending U.S. patent application Ser. No. 139,252 relates to a modification in the abovementioned U.S. Pat. No. 4,002,354, wherein a non-ski boot can be utilized in conjunction with the binding. Other ski equipment developed for use in both alpine and touring skiing is evidenced by U.S. Pat. Nos. 3,945,134 and 4,157,191, which patents are also of common ownership with the present invention.

None of the prior art combination alpine and touring ski bindings have utilized a binding that is integral to the boot to connect to the ski. Thus, relatively complex binding structures connected to the ski alone have been utilized to combine the features of both alpine and touring skiing. One such complex binding is seen in U.S. Pat. No. 3,490,781 to Marker, wherein a toe iron or toepiece that can be utilized for both alpine and touring skiing is disclosed. Specifically, Marker utilizes a toe iron having arms which laterally grip the boot of a skier.

Some ski bindings have been utilized for purely alpine skiing that do incorporate some aspects of the binding into the boot. Such bindings are seen in U.S. Pat. No. 3,797,841 to McAusland and U.S. Pat. No. 3,771,806 to Hinterholzer.

Boots that must be directly clamped to the ski to accomplish both alpine and touring skiing are most often very rigid. Such boots cannot be readily removed from the ski for purposes of walking.

Considerable expert opinion exists to the effect that a releasable ski binding for alpine skiing would ideally be located directly underneath the leg of the skier, rather than at the toe and heel, as is most often utilized in modern ski technology. Examples of such bindings, limited only to alpine skiing, are seen in U.S. Pat. No. 3,606,370 to Spademan and U.S. Pat. No. 3,779,570 to Betschart.

No one, in attempting to combine alpine and touring skiing equipment, has seen the advantage, or been able to provide equipment that takes advantage of, variation of the longitudinal position of the ski boot relative to the ski. Such a feature of alpine and touring ski equipment is desirable because, in touring skiing, the skier is most advantageously located at approximately the balance point or center of gravity of the ski. This particular location therefore allows the tip of the ski to be easily lifted and yet quickly contact the surface of the snow as the skier performs the striding motion associated with touring skiing.

In alpine skiing, on the other hand, the skier is most advantageously positioned slightly in front of the position most advantageous for touring skiing. This position arises from the fact that parallel turns are most easily made, and therefore control best maintained, when the skier does not have to turn a great length of ski protruding in front of him. This concept is perhaps most readily understood when one looks at present methods of teaching downhill skiing, wherein very short skis are utilized and only gradually does the skier move on to longer skis.

OBJECTS AND SUMMARY OF THE INVENTION

It is the principal object of the present invention to provide a simple ski binding that can be utilized in both alpine and touring skiing.

It is a related object of the present invention to provide a ski binding that can be readily converted from alpine to touring skiing, or vice versa.

A further related object of the present invention is to provide a ski boot and integral binding, that when released from the ski, is readily adaptable to walking, hiking or climbing.

It is a further object of the present invention to optimize the skier's position on a ski for both alpine and touring skiing.

It is a still further related object of the present invention to provide a releasable ski binding that is placed at an optimum position for turning control when the binding is utilized as an alpine binding.

In accordance with the objects of the invention, a boot and boot plate, forming an integral ski binding, are adapted to be selectively connected to a toepiece mounted on a ski. The toepiece has laterally extending pins with rounded ends that fit into concave recesses at the end of a pair of parallel extending elongated members of the boot plate. The connection between the elongated members and the laterally extending pins permits relative pivotal motion between the ski and integral boot binding about an axis tranverse to the longitudinal axis of the ski.

A heelpiece is rotatably connected to the ski near a heel of the boot. A heel of the boot is a curvilinear shape providing a spring biasing action of the boot away from the ski for assistance in cross-country or touring skiing. The heelpiece can assume any one of three positions. In a first position, the heelpiece underlies the heel of the boot to place the boot in an angular position relative to the ski, which position enhances traversing up inclines. In a second position, the heelpiece is rotated ninety degrees from the first position, and does not interact at all with the heel of the boot. In the second position, the heel of the boot is free to raise and lower during touring skiing. In a third position, the heelpiece is rotated another ninety degrees, to clamp over the heel and fix the heel of the boot relative to the ski. In this third position, alpine skiing is readily accomplished.

When the integral binding is released from the ski, a cover or sole is adapted to be slid over the boot plate and protect the boot plate from damage during walking, hiking or climbing. The sole is slightly rounded on an underneath surface thereof to assist the skier in walking in the relatively rigid boot.

In an alternative embodiment, the boot plate is selectively positionable relative to the boot. A forward end of the boot plate can project toward a forward end of the boot and connect to the toepiece for utilization as a touring binding as in the previously described embodiment. The boot plate can be pivoted one hundred eighty degrees, directing the forward end of the boot plate rearwardly and placing the forward end of the boot plate approximately directly underneath the leg of a skier. Reconnecting the forward end of the boot plate to the toepiece allows the binding to be utilized as an alpine ski binding. The interaction of the heel of the boot and boot plate with the ski prevent the integral boot binding from pivoting forwardly or rearwardly about the toepiece.

BRIEF DESCRIPTION OF THE DRAWINGS

FIG. 2 is a perspective view of the boot plate of the invention shown in FIG. 1.

FIG. 3 is a side elevational view of the invention shown in FIG. 1 being utilized for touring skiing.

FIG. 7 is a side elevational view of the alternative embodiment shown in FIG. 5 being utilized for alpine skiing.

FIG. 8 is a fragmentary enlarged sectional view taken in the plane of line 8—8 of FIG. 7.

FIG. 9 is a perspective view of the boot plate shown in FIG. 1 with a sole adapted to cover the boot plate when the boot is released from the ski for walking.

DESCRIPTION OF THE PREFERRED EMBODIMENTS

Figure 1:
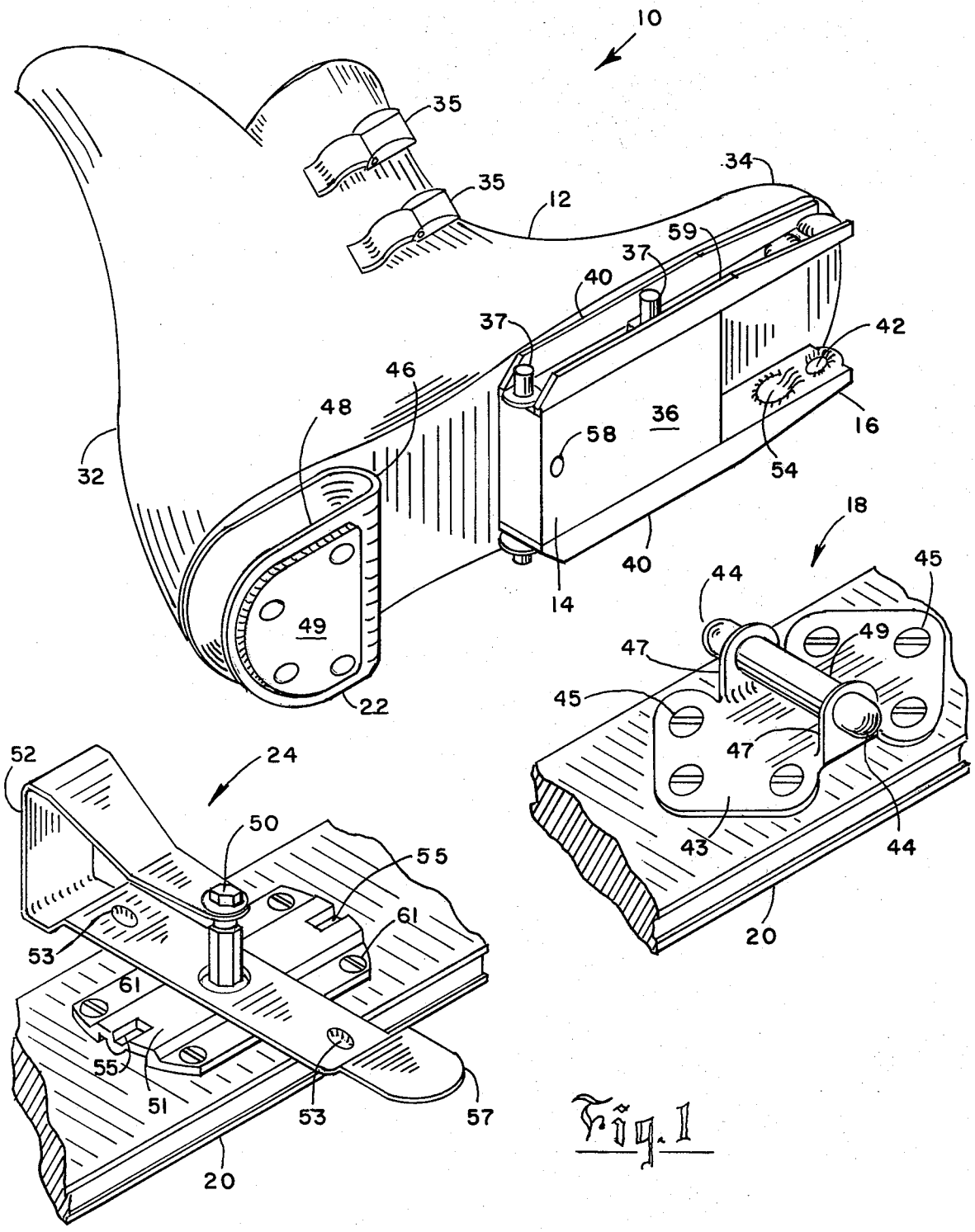
FIG. 1 is a fragmentary exploded perspective view of the integral binding, including a boot and connected boot plate, a toepiece and heelpiece being shown connected to a ski.

An integral boot-boot plate binding 10 for use in either alpine or touring skiing is seen in FIG. 1 to include an integral boot 12 and boot plate 14. The boot plate is part of an entire binding system which further includes a toepiece 18 and a heelpiece 24. The boot plate 14 is releasably connectable to a ski 20 by the toepiece. The boot 12 retains a foot of a skier (not shown) for the purpose of combining alpine and touring skiing and is connected to the heelpiece through a resilient boot heel 22 rigidly fixed to the boot. In a touring skiing mode, the boot plate 14 (FIG. 2) is pivotally connected at a forward end 16 thereof to the toepiece 18 portion of the binding. The toepiece is in turn rigidly connected to the ski 20, which ski is adaptable for use in combination as an alpine or touring ski (FIG. 3). The boot heel 22 is therefore free to lift from the ski 20 and help achieve the leg and foot motion of touring skiing. In alpine skiing, the heel 22 is held against the ski by the heelpiece 24.

The boot 12 must function in a combination role as a touring boot and as an alpine boot. The boot 12 must be rigid enough to withstand the lateral forces applied during an alpine parallel turn and yet not be as rigid as true alpine boots, which would severely restrict, or even prohibit, in some cases, any attempt to pivot forwardly about the ankle. A boot sold by the Micron Division of Gamebridge, Inc. of Winooski, Vermont under the designation "Model Select", is particularly well suited for use in the integral boot-boot plate binding 10. The boot 12 has a forward portion 34, essentially conforming to that part of the human foot protruding in front of the leg, and a rearward portion 32, conformably fitting the foot and ankle from the leg back. Once the foot is inserted into the boot 12, any one of a number of conventionally available tension latches 35 are utilized to tighten the boot 12 around the foot.

Figure 4:
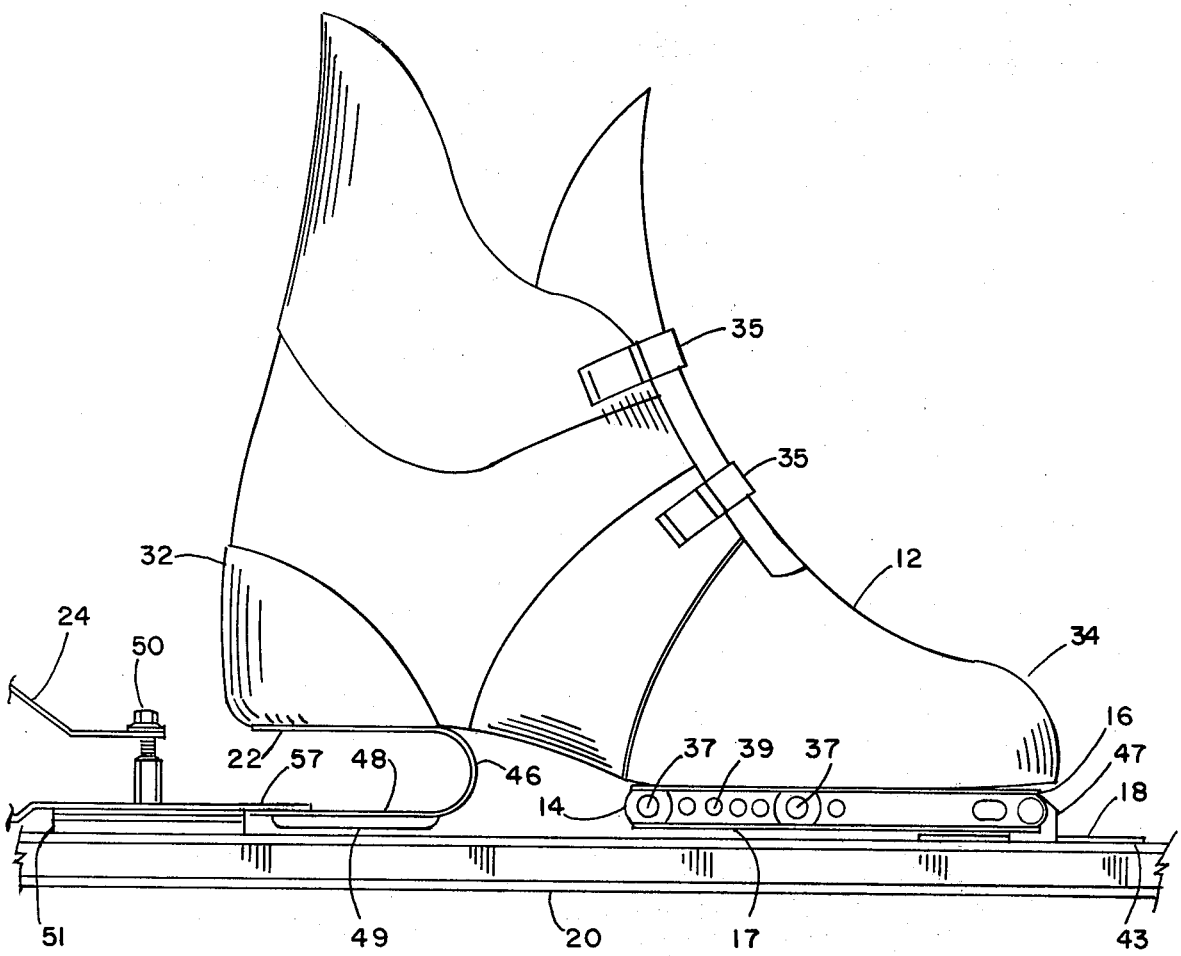
FIG. 4 is a side elevational view of the invention shown in FIG. 1 being utilized for alpine skiing.

As mentioned previously, the rearward portion 32 of the boot 12 includes a resilient heel 22 (FIGS. 3 and 4). The heel 22 is made of a single piece of "C" shaped curvilinear steel band approximately as wide as the rearward portion 32. The "C" shape is open toward the rear of the boot 12. The heel 22 includes a curved portion 46 and a flat portion 48, which flat portion includes a pad 49 connected thereto. The heel 22 can rest flush with the ski 20 on the pad 49 of the flat portion 28, at which time the boot plate 14 is parallel to the ski 20. The weight of a skier compresses the heel 22, so that as the weight of the skier is transferred by the pivotal movement of the binding 10 during the touring skiing action, the heel acts as a spring to bias the boot 12 away from the ski. This biasing action of the boot 12 away from the ski imparted by the heel, enhances touring performance.

The boot piece 14 includes a block portion 36 (FIG. 2) of generally flat, rectangular solid configuration. The block portion 36 is fixedly secured to the underside of the forward portion 34 of the boot by any conventional means such as screw-type fasteners. The boot plate 14, which does not connect to the rearward portion 32 of the boot 12, does not restrict any more than necessary the flexibility of the boot. The block is made of a high-strength and lightweight plastic. The block 36 is generally as wide and as long as the forward portion 34, so that substantially uniform transfer of forces from the skier's foot to the boot through the block and finally to the ski 20 occurs. The block is also relatively thin, compared to the width of the block, so that the skier feels he is part of the ski 20, and not raised significantly above it.

Semirigid, elongated spring bar members 40 are attached to opposite sides 38 of the block 36 by elongated bolts 37, passing through lateral bores 39 in the block 36 and the elongated spring bar members 40. Elongated spring bars of the general type utilized herein are described in detail in my prior U.S. Pat. No. 4,002,354, issued Jan. 11, 1977, which description is incorporated herein as though fully set forth.

To the extent the elongated spring bar members 40 vary from the description set forth in U.S. Pat. No. 4,002,354, some additional explanation is required. The elongated spring bar members 40 are formed of narrow strips, having a channel 59 formed therein, of high-strength steel adapted to connect to and release from the toepiece 18. Each elongated member therefore includes at the forward end 16, on an inside surface thereof, a toepiece recess 42 which is adapted to releasably receive pins 44 mounted on the toepiece 18 and extending laterally therefrom, which pins are also described in my prior patent (FIGS. 1 and 2). Just rearward of the toepiece recess 42 is positioned a slightly elongated mounting recess 54 providing for selective connection and disconnection between the elongated members and the toepiece 18, which connection will be described in detail hereinafter.

The toepiece 18 is rigidly connected, as by screws 45, to the ski 20 by a toepiece mounting plate 43. A pair of parallel upwardly directed ears 47, which ears are integrally connected to the mounting plate 43, mount therebetween a cylindrical rod 49 having the pins 44 integrally formed at either end thereof. The toepiece will be seen to be a key component of the integral boot plate binding 10 during touring skiing, by allowing pivotal movement about an axis along the rod 49.

The novel heelpiece 24 further enhances touring performance, or can be utilized to convert the binding 10 to the alpine mode. The heelpiece 24 is formed from a metal strip or body bent into a predetermined shape. A bolt 50 rotatably connects the heelpiece 24 to the ski through a mounting plate 51, which mounting plate is fixed to the ski 20 by screws 61. The heelpiece 24 has protuberances 53 which interact with detents 55 on the mounting plate to releasably set the position of the heelpiece 24.

One end of the heelpiece 24 terminates in an elevated portion 52, while the other end comprises a clamping portion 57. The elevation portion 52 is formed by making two bends in the metal strip of the heelpiece, resulting in a generally triangular side view, as seen in FIG. 3. The clamping portion 57 is generally flat so as to be adapted to overly the flat portion 48 of the heel 22, for a purpose to be described shortly.

The boot 12 and connected boot plate 14 are releasably attached to the ski 20 by inserting one pin 44 of the toepiece 18 into one of the mounting recesses 54 of one of the elongated members 40. The other pin 44 is inserted into the toepiece recess 42 of the other elongated member 40. Pivoting of the boot 12 and connected boot plate 14 relative to the ski 20 will spread the elongated members 40 enough to permit the first mentioned pin 44 to enter the other toe piece recess 42 to thereby connect the boot plate to the ski 20 in the desired manner. The process is reversed to disconnect the binding 10. The same principle, flexure of the elongated members 40, provides for release of the binding 10 during an unscheduled fall.

Touring skiing requires a pivotal movement about the forward portion of the boot 34. The configuration of the rounded pins 44, and associated concave spring bar recess 42 allows the binding 10 to pivot about the longitudinal axis of the rod 49 and pins 44, which axis is transverse to the longitudinal axis of the ski 20. The boot 12 is itself capable of some bending as the boot and boot plate 14 are pivoted about the toepiece 18. The boot is not unduly restricted from bending because, as has been previously described, the boot plate 14 is only connected to the forward portion 34 of the boot.

In touring, the heelpiece 24 is either positioned transverse to the length of the ski 20 (FIG. 1), so as not to interfere at all with the up and down motion of the heel 22, or with the elevated portion 52 of the heelpiece 24 at a position immediately underlying the heel 22 of the boot 12 (FIG. 3). The elevated portion 52 allows a skier to maintain an angle between the boot 12 and the ski 20, which angle is particularly useful in uphill climbing.

During alpine skiing, the heelpiece 24 is pivoted about the bolt 50 to a third position, wherein the clamping portion 57 is brought into association with the heel 22 (FIG. 4). The clamping portion 57 is placed overlying the flat portion 48 of the heel 22, thus preventing the heel from being raised.

It is seen that the portion of the integral boot binding 10 formed from the boot 12 and connected boot plate 14, is adaptable to release from the toepiece 18 and heelpiece 24 of the binding. The skier can then walk, hike or climb with considerable efficiency. To protect the boot plate 14 from damage, and to allow easier walking, a cover or sole 26 is slipped over the boot plate 14 and elongated members 40 (FIG. 9). The channel portion 59 of elongated members 40 receives an inwardly directed tank 30 of the sole 26. A curved surface 28 of the sole 26 makes walking easier and protects the boot plate 14. The curved surface 28 can be made from rubber or other suitable material.

Locking means are provided between the sole 26 and the boot plate 14. The locking means includes a spring ball 56 mounted in an upper flat surface 55 of the sole 26 (FIG. 9) which ball 56 is releasably received in a corresponding hole 58 in the exterior face of the block 36 (FIG. 1). The sole 26 can be withdrawn by simply pulling the sole from the boot plate 14.

An alternative embodiment of the integral boot-boot plate binding 10 is seen in FIGS. 5 through 8, with like parts having been given prime suffixes. The binding 10' operates in the same manner as has been described for touring previously, with the exception that a heelpiece 24 would not be attached to the ski 20'. Pivot or swivel means 60 (FIG. 6) are added to permit selective positioning of the boot plate 14' relative to the boot 12'. In a first position, FIG. 5, touring-type skiing is accomplished in the manner described. In a second position, the forward end 16' of the boot plate 14' is pivoted one hundred eight degrees to a position shown in FIG. 7, where the toepiece recess 42' is approximately at the point where the forward portion 34' meets the rearward portion 32' of the boot 12'. At this midpoint position, the boot 12' is releasably connected to the toepiece 18'. Furthermore, the boot plate 14' and heel 22' are flush against the ski 20', rigidly holding the boot and boot plate in place.

Figure 10:
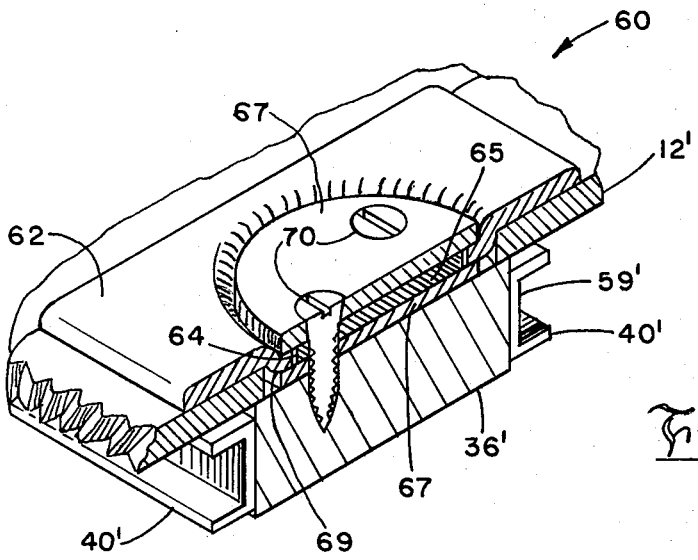
FIG. 10 is an enlarged fragmentary perspective view of the pivot means of the alternative embodiment.
Figure 5:
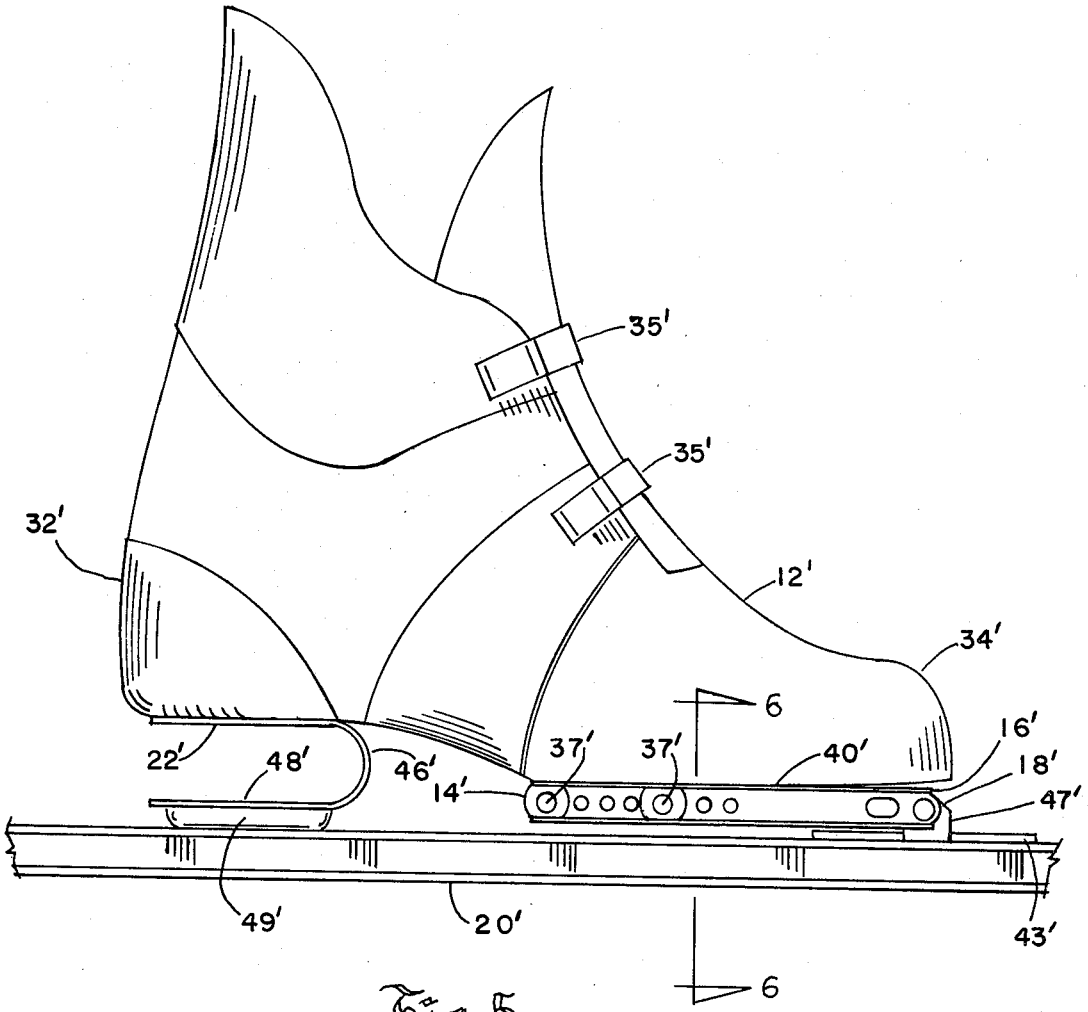
FIG. 5 is a side elevational view of an alternative embodiment of the present invention wherein the boot plate is selectively positionable and no heelpiece is necessary on the ski.
Figure 6:
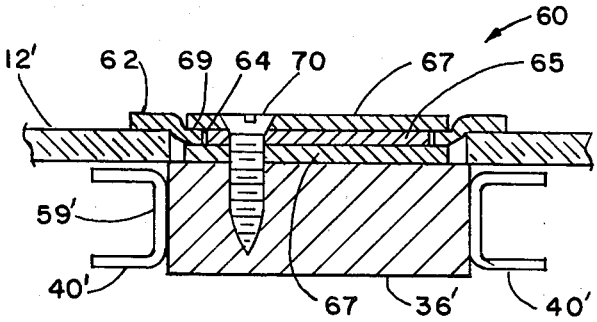
FIG. 6 is a fragmentary enlarged sectional view taken in the plane of line 6—6 of FIG. 5.

Alternate positioning of the boot plate 14' relative to the boot 12' is accomplished by the pivot means 60, which pivot means includes a bearing 62 interiorly mounted into the boot 12' (FIGS. 6 and 10). The bearing 62 has a circular opening 64 defined by an inwardly turned lip 69. A swivel member 65 is placed in the opening 64 and rotatably mounted to the bearing 62 by a pair of circular spacers 67 rigidly connected to the swivel member and which spacers are positioned on either side of the lip 69 of the bearing 60. The swivel member 65 and spacers 67 are rigidly connected to the block 36' of the boot plate 14' by three screws 70, one of which is seen in FIG. 6.

The pivot means 60 are held in place at a selected position by a pin 72 pivotally mounted in the boot plate 14' (FIGS. 8 and 10). The pin 72 is received in a corresponding hole 74 in the boot 12', a hole being provided for each selected position. A lever 76 can insert the pin into the hole, or retract the pin from the hole. Together the pin and hole provide means for holding the boot plate 14' in the selected position relative to the boot 12'.

An ideal alpine-touring binding 10' is provided in the alternative embodiment. Only a single toepiece 18' having two lateral pins 44' is necessary. No additional elements are mounted on the ski 20'. Ideal release positioning directly under the leg of a skier is provided in the alpine skiing mode.

Such alternate positioning enhances the total skiing experience by adjusting the skier's position along the ski 20'. The toepiece 18' is, of course, stationary at essentially the balance point or longitudinal center of gravity of the ski 20'. This is an ideal position for touring when the boot 12' is connected to the toepiece by the boot plate 14' because the front of the ski 20' stays at essentially a neutral position and therefore can be easily lifted and alternatively placed against the surface of the snow.

When alpine skiing is desired, the skier should be moved slightly toward the front of the ski 20', making turning easier and achieving better control. By connecting the toepiece 18' at approximately the middle of the skier's foot length, the skier is essentially moved forward on the ski several inches. The same releasable connection between the boot plate 14' and the toepiece 18' is available at this single mounting position. The heel 22', mounted on the rearward portion 32' of the boot 12', and the boot plate 14', mounted at the forward portion 34' of the boot 12', prevent forward or backward pivotal movement about the toepiece 18' by reason of their position resting against the ski 20'.

A tension adjustment pad 17 can be placed underneath the block 36 in either embodiment for alpine skiing. The further the pad 17 is placed from the toepiece 18, the greater the release force necessary to separate the integral boot-boot plate binding 10 from the ski 20. The closer the pad 17 is placed to the toepiece 18, the less force of release is required.

Figure 12:
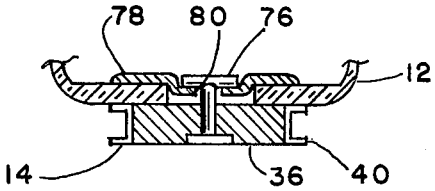
FIG. 12 is an enlarged sectional view of an alternative embodiment for connecting the boot to the boot plate, shown in a locked position.
Figure 11:
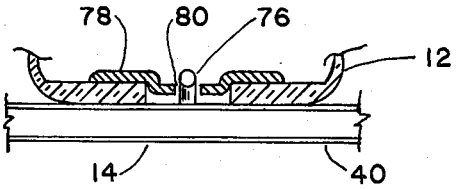
FIG. 11 is an enlarged sectional view of an alternative embodiment for connecting the boot to the boot plate, shown in an unlocked position.

An alternative embodiment to the pivot means 60 of FIGS. 6 and 10 connecting the boot 12 and boot plate 14, is seen in FIGS. 11 and 12. A "T" shaped connector 76 is rigidly mounted on the block 36 on a surface of the block adjacent to the boot 12. The boot contains a plate 78 which plate has a slot 80 therein. The "T" of the connector is adapted to fit in the slot. The boot plate 14 therefore interlocks the connector and plate in one position (FIG. 12). The boot plate can be totally removed and a walking sole (not shown), similar to the sole 26, can be inserted therefor by rotating the boot plate 14 to align the connector "T" with the slot 80, and removing the boot plate (FIG. 11). The boot plate 14 can be held in position by the pin means 72 of FIG. 8 already described.

Although the present invention has been described with a certain degree of particularity, it is understood that the present disclosure has been made by way of example and that changes in detail structure may be made without departing from the spirit thereof.

What is claimed is:

1. A boot-boot plate binding for releasably connecting a foot of a skier to a ski comprising in combination:

a toe piece mounted on said ski including retention means extending laterally of said ski;

a boot plate having a block portion and semirigid elongated member means extending longitudinally of said ski, said elongated member means having connection means on forward ends thereof for releasable and pivotable connection to said retention means;

a boot being conformable to and adapted to retain the foot of said skier, said boot being fixedly connectable to said boot plate at selected locations for movement therewith whereby the boot and boot plate can pivot about a lateral axis of said ski.

2. A binding for releasably connecting a foot of a skier to a ski comprising in combination:

a toepiece mounted on said ski having retention means extending laterally of said ski;

a boot plate having a block portion and semirigid elongated member means extending longitudinally of said ski, said elongated member means having connection means on the forward ends thereof for releasable, pivotal connection to said retention means; and a boot having a forward portion and a rearward portion, said forward portion of said boot being connected to said boot plate in such a manner that said boot plate is selectively positionable relative to said boot.

3. The invention as defined in claim 2 wherein said selectively positionable boot plate further includes a movable mounting means connecting said boot plate to the boot whereby the boot plate can be placed in a first position wherein said forward ends of said elongated member means are directed forwardly relative to the boot; and a second position wherein said forward ends of said elongated member means are directed rearwardly relative to said boot.

4. The invention as defined in claim 3 wherein said movable mounting means is a swivel mounting means for providing relative rotation between said boot plate and said boot.

5. The invention as defined in claim 4 wherein said swivel mounting means further include:

a bearing having an opening therein and an inwardly turned circumferential lip, said bearing rigidly mounted into the boot;

a swivel member placed into the opening of said bearing, said swivel member rotatably connected to said bearing; and connection means for joining said swivel member to said boot plate.

6. The invention as defined in claim 4 further including means for releasably holding said boot plate in said selected positions.

7. The invention as defined in claim 6 wherein said means for releasably holding said boot plate in said selected positions further includes:

pin means reciprocably mounted in one of said boot plate and boot, said pin means adapted to be urged away from said one of said boot plate and boot and toward the other of said boot plate and boot; and at least two pin receiving means in the other of said boot plate and boot adapted to receive said pin means and prevent relative rotation between said boot and said boot plate, each pin receiving means located to correspond to one of said selected positions.

8. A boot plate binding for releasably connecting a foot of a skier to a ski comprising in combination:

a toe piece mounted on said ski including retention means extending laterally of said ski;

a boot plate having a block portion and semirigid elongated members means extending longitudinally of said ski, said elongated member means having connection means on forward ends thereof for releasable pivotable connection to said retention means;

a boot being conformable to and adapted to retain the foot of said skier, said boot being fixedly positioned relative to said boot plate for movement therewith whereby the boot and boot plate can pivot about a lateral axis of said ski;

cover means releasably mountable on said boot plate; and retention means for retaining said cover means on said boot plate including a detente on one of said boot plate and cover means and a spring loaded ball on the other of said boot plate and cover means, said ball being adapted to be releasably seated in said detente.

9. A boot plate binding for releasably connecting a foot of a skier to a ski comprising in combination:

a toe piece mounted on said ski including retention means extending laterally of said ski;

a boot plate having a block portion and semirigid elongated member means extending longitudinally of said ski, said elongated member means having connection means on forward ends thereof for releasable and pivotable connection to said retention means;

a boot being conformable to and adapted to retain the foot of said skier, said boot being fixedly positionable with respect to said boot plate for movement therewith whereby the boot and boot plate can pivot about a lateral axis of said ski;

a spring biased heel fixedly connected to said boot, said heel including a curvilinear band having a curved portion curved forwardly relative to said boot and a flat portion adapted to abut the top surface of said ski; and a heel piece rotatably connected to said ski including an elevated portion at one end thereof and a clamp portion at another end thereof, said ends of said heel piece being selectively positionable to three different positions corresponding to three different modes of operation, a first position wherein said clamping portion overlies said flat portion of said curvilinear boot heel and holds the boot against the ski, a second position wherein the elevated portion underlies said flat portion of said curvilinear boot heel and supports said boot heel at an elevated position and a third position wherein said heel piece does not contact said curvilinear boot heel.

* * * * *